US006477867B1

(12) United States Patent
Collecutt et al.

(10) Patent No.: US 6,477,867 B1
(45) Date of Patent: Nov. 12, 2002

(54) LAUNDRY APPLIANCE

(75) Inventors: Gregory Raymond Collecutt; David Charles Rhodes, both of Auckland (NZ)

(73) Assignee: Fisher & Paykel Limited, Auckland (NZ)

( * ) Notice: Subject to any disclaimer, the term of this patent is extended or adjusted under 35 U.S.C. 154(b) by 0 days.

(21) Appl. No.: 09/467,660

(22) Filed: Dec. 20, 1999

(30) Foreign Application Priority Data

Dec. 23, 1998 (NZ) ..... 333573

(51) Int. Cl.[7] ..... D06F 37/22

(52) U.S. Cl. ..... 68/12.06; 68/12.04; 68/23.2; 73/573 F

(58) Field of Search ..... 74/573 R, 573 F; 68/12.06, 12.04, 23.2

(56) References Cited

U.S. PATENT DOCUMENTS

| | | | | | |
|---|---|---|---|---|---|
| 2,534,267 | A | | 12/1950 | Kahn | |
| 2,534,269 | A | | 12/1950 | Kahn et al. | |
| 2,647,386 | A | * | 8/1953 | Keiprt | 68/23.2 |
| 3,117,926 | A | * | 1/1964 | Starr et al. | 68/12.06 |
| 3,119,773 | A | * | 1/1964 | Compans | 68/23.2 |
| 3,214,946 | A | * | 11/1965 | Starr et al. | 68/23.2 |
| 3,235,082 | A | * | 2/1966 | Compans | 68/23.2 |
| 3,983,035 | A | * | 9/1976 | Arkeveld et al. | 68/23.2 |
| 4,292,769 | A | * | 10/1981 | Maag et al. | 74/573 R |
| 4,295,387 | A | * | 10/1981 | Zhivotov et al. | 74/573 F |
| 4,857,814 | A | | 8/1989 | Duncan | |
| 4,905,419 | A | * | 3/1990 | Makarov et al. | 74/573 F |
| 4,991,247 | A | * | 2/1991 | Castwell et al. | 68/23.2 |
| 5,280,660 | A | * | 1/1994 | Pellerin et al. | 68/12.06 |
| 5,345,792 | A | * | 9/1994 | Farrington et al. | 68/23.2 |
| 5,561,993 | A | * | 10/1996 | Elgersman et al. | 68/23.2 |
| 6,134,926 | A | * | 10/2000 | Vande Harr et al. | 68/12.06 |
| 6,210,099 | B1 | * | 4/2001 | Hugbart et al. | 74/573 R |

FOREIGN PATENT DOCUMENTS

| | | | | |
|---|---|---|---|---|
| CA | 990528 | * | 6/1976 | 68/23.2 |
| EP | 0856604 | | 8/1998 | |
| GB | 1598399 | | 9/1981 | |
| WO | WO9953130 | | 10/1999 | |

OTHER PUBLICATIONS

European patent application 476,423 Mar. 1992, 68/23.2.*

* cited by examiner

*Primary Examiner*—Frankie L. Stinson
(74) *Attorney, Agent, or Firm*—Trexler, Bushnell, Giangiorgi, Blackstone & Marr, Ltd.

(57) ABSTRACT

A balancing system for a laundry appliance is disclosed, which is particularly suited to horizontal axis washing machines. The system includes force and acceleration transducers at each end of the drum, to detect the imbalance. Several algorithms are disclosed, which calculate the correction required to correct for the imbalance. The correction is implemented using a set of balancing chambers, at each end of the drum. The advantages include the traditional mechanical suspension to be dispensed with, and that the system is capable of adapting to different types of floors.

13 Claims, 11 Drawing Sheets

LAUNDRY APPLIANCE

BACKGROUND OF THE INVENTION

1. Field of Invention

This invention relates to a system for balancing the load in a laundry appliance, particularly but not solely, a system for balancing the load in a horizontal axis washing machine.

2. Description of the Prior Art

Conventional horizontal axis washing machines involve a final spin cycle to extract the washed articles of as much of water as possible to reducing drying tie. However, the requirement of a high spin speed is at odds with quiet operation At the beginning of a spin the cycle the wash load can be quite severely unbalanced, such that when the machine tries to accelerate noise and stressful vibrations result.

The means that washing machine designers have employed so far to cater for imbalance in the load, is typically to suspend the internal assembly on springs and dampers in order to isolate its vibration, The difficulty is these suspension assemblies never isolate the vibration completely, and as the machine ages they deteriorate and the problem gets worse. Also, these suspension assemblies require significant internal clearance, and so valuable load capacity is lost when designing a machine to standard outside dimensions. Further, because the internal assembly must still withstand the forces due to the imbalance, considerable extra costs result.

The ideal approach is to eliminate the problem at its source, for which there are various solutions. The first possibility is to ensure that the wash load is evenly distributed prior to spinning. This is an effective solution but it is extremely difficult to achieve in practice. Therefore while steps can be taken to reduce the degree of imbalance that must be catered for, it is not possible to eliminate it sufficiently to ignore it there after. Another approach is to determine the size and nature of the imbalance, and add an imbalance that exactly counteracts the first.

Methods of compensating for imbalance in horizontal axis washing machines have been disclosed in U.S. Pat. No. 5,280,660 (Pellerin et al.), European Patent 856604 (Fagor, S. Coop). These disclosures relate to the use of three axially orientated chambers running the length of the drum, displaced evenly around the periphery of the drum, which when individually filled with water in the appropriate amounts can be used to approximately correct imbalances in the axis of rotation.

The disadvantage to these systems is that the imbalance may not be centered along the axis of rotation, and since no control is available along the axis of rotation this form of balancing will only ever be partially successful. This may mean that a suspension system may still be required to isolate the vibrations, which adds cost and may reduce the useful life of the appliance.

Static Imbalance

When an object of some shape or form is spun about a particular axis, there are two types of imbalance that it may exhibit: Static and Dynamic. Static imbalance is where axis of rotation does not pass through the Centre of Gravity (CoG) of the object. This means that a force, F, must be applied to the object (acting through the CoG) to keep accelerating the object towards the axis of rotation. This force must come from the surrounding structure and of course its direction rotates with the object, as illustrated in FIG. 1. There are two pieces of information required to define a static imbalance 3. They are the magnitude of the imbalance 1 (the moment of the CoG about the spin axis, which in SI units has dimensions kg m), and some angle 2 between the direction of the offset of the CoG and some reference direction within the object 4.

When mounted on a horizontal rotation axis, and under the influence of gravity, an object with a static imbalance will rotate until its CoG lies vertically under its axis of rotation. This also has the consequence that a horizontal axis machine, running at speeds slower than its resonance on its suspension and at constant power input, will exhibit a slight fluctuation in rotation speed as the CoG goes up one side and down the other. Unfortunately this is not a feasible technique for determining static imbalance at anything other than very slow speeds.

Dynamic Imbalance

Dynamic Imbalance is a little more complicated. In FIG. 2 the axis of rotation 5 is not parallel with one of the principle axes 6 of the object. The principal axes of an object are the axes about which the object will naturally spin.

For example, consider a short length of uniform cylinder 7 set to spin about its axis of extrusion, and thus is both statically and dynamically balanced Two weights are now attached to the inside of the cylinder, one 8 at one end and the other 9 at the other end but on the opposite side from the first one. The CoG 10 of the object has not been moved and so it is still statically balanced, but now spinning the cylinder will cause vibration; it has a dynamic imbalance. Static imbalance can be detected statically by seeing which way up the object rolls over to rest. Dynamic imbalance can only be detected with the cylinder spinning, i.e. dynamically.

SUMMARY OF THE INVENTION

It is an object of the present invention to provide a balancing system for a laundry appliance which goes as far as is practical for its purpose towards overcoming the above mentioned disadvantages.

Accordingly in a first aspect, the present invention consists in a laundry appliance comprising:

- a perforated rotatable drum for dehydrating a clothes load,
- a substantially rigid, free standing drum support means supporting said drum rotatably but non-translatably in relation to a support surface,
- driving means for rotating said drum at speed thereby dehydrating the load, and
- a system for compensating for imbalances of said drum and any load carried therein during dehydration of the load.

In a second aspect, the present invention consists in a laundry appliance having a perforated drum for dehydrating a clothes load, driving means adapted to rotate said drum at speed thereby dehydrating the load and a system for compensating for imbalances of said drum and any load carried therein during dehydration of the load, said system comprising:

- first sensing means located at more than one position on the drum spin axis for detecting dynamic rotational imbalance in the load,
- a digital processor which in use receives as inputs signals from said sensing means, and programmed to calculate the value and position of one or more masses required to be added to the drum to correct the sensed imbalance,
- correction means for adding two or more masses to said drum, wherein in use at least one of said masses being axially spaced from the remainder of said masses and said processor controlling such additions such that the resultant value and position is substantially similar as the calculated value and position to correct the imbalance.

In a third aspect, the present invention consists in a laundry appliance having a perforated drum for dehydrating a clothes load, driving means adapted to rotate said drum at speed thereby dehydrating the load and a system for compensating for imbalances of said drum and any load carried therein during dehydration of the load, said system comprising:

first sensing means located at more than one position on the spin axis of said drum for detecting rotational imbalance in the load, correction means for adding two or more masses to said drum to correct for any imbalance caused by the rotation thereof, and a digital processor which in use receives as inputs signals from said sensing means and programmed with software causing said processor to carry out the following steps.

a) energising said driving means to apply a first predetermined rate of rotation to said drum;

b) instructing said correction means to add at least one small imbalance to at least one end of said drum and storing the detected rotational imbalances at each end of said drum;

c) determining the differential relationship between said at least one added imbalances' and said detected rotational imbalances' at each end of said drum, thereby estimating the value and position of one or more masses required to be added to the drum to correct the actual imbalance; and d) controlling additions of one or more masses to said drum by said correction means such that the resultant value and position of the added masses is substantially similar to the said estimated value and position to correct the imbalance.

In a fourth aspect, the present invention consists in a laundry appliance having a perforated drum for dehydrating a clothes load, driving means adapted to rotate said drum at speed thereby dehydrating the load and a system for compensating for imbalances of said drum and any load carried therein during dehydration of the load, said system comprising:

first sensing means located at one or more positions on the spin axis of said drum for detecting rotational imbalance in the load with respect to the spin axis of said drum, second sensing means located at one or more positions on the spin axis of said drum for determining the absolute acceleration of the spin axis of said drum, a digital processor which in use receives as inputs signals from said first and second sensing means and programmed to estimate the value and position of one or more masses required to be added to the drum to correct the sensed imbalance, correction means for adding one or more masses to said drum, said processor in use controlling such additions such that the resultant value and position of the added masses is substantially similar as the said estimated value and position to correct the imbalance.

The invention consists in the foregoing and also envisages constructions of which the following gives examples,

BRIEF DESCRIPTION OF THE DRAWINGS

One preferred form of the present invention will now be described with reference to the accompanying drawings in which.

DETAILED DESCRIPTION OF THE PREFERRED EMBODIMENTS

The present invention provides a novel method of balancing the load in a laundry appliance, particularly suited to washing machines. Such a system dispenses with the need for suspension, and this significantly simplifies the machine design. The following description is with reference to a horizontal axis machine. However it will be appreciated that the present invention will be applicable to off horizontal and vertical machines, as well as rotating laundry appliances in general.

General Appliance Construction

Figure 1:
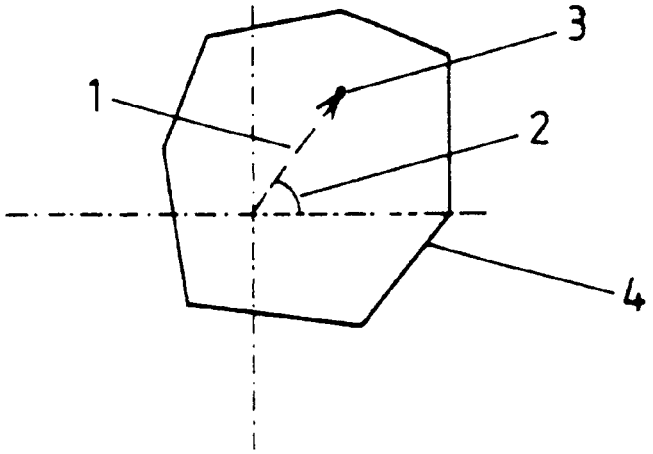
FIG. 1 is an illustration of the concept of static imbalance.
Figure 2:
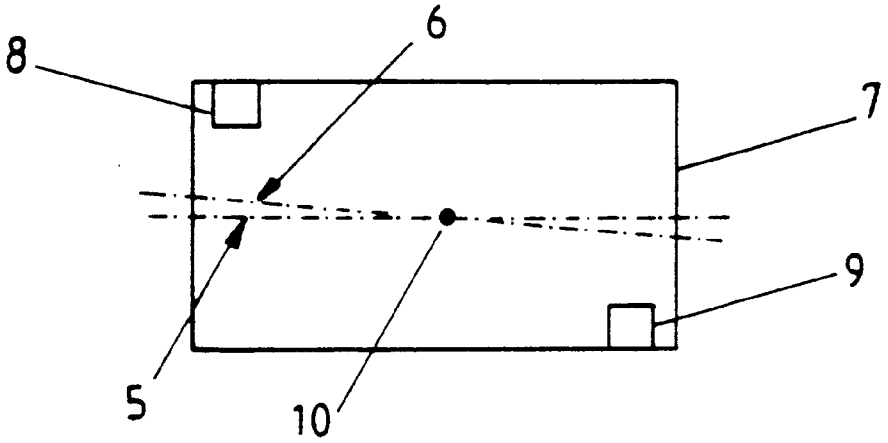
FIG. 2 is an illustration of the concept of dynamic imbalance.
Figure 3:
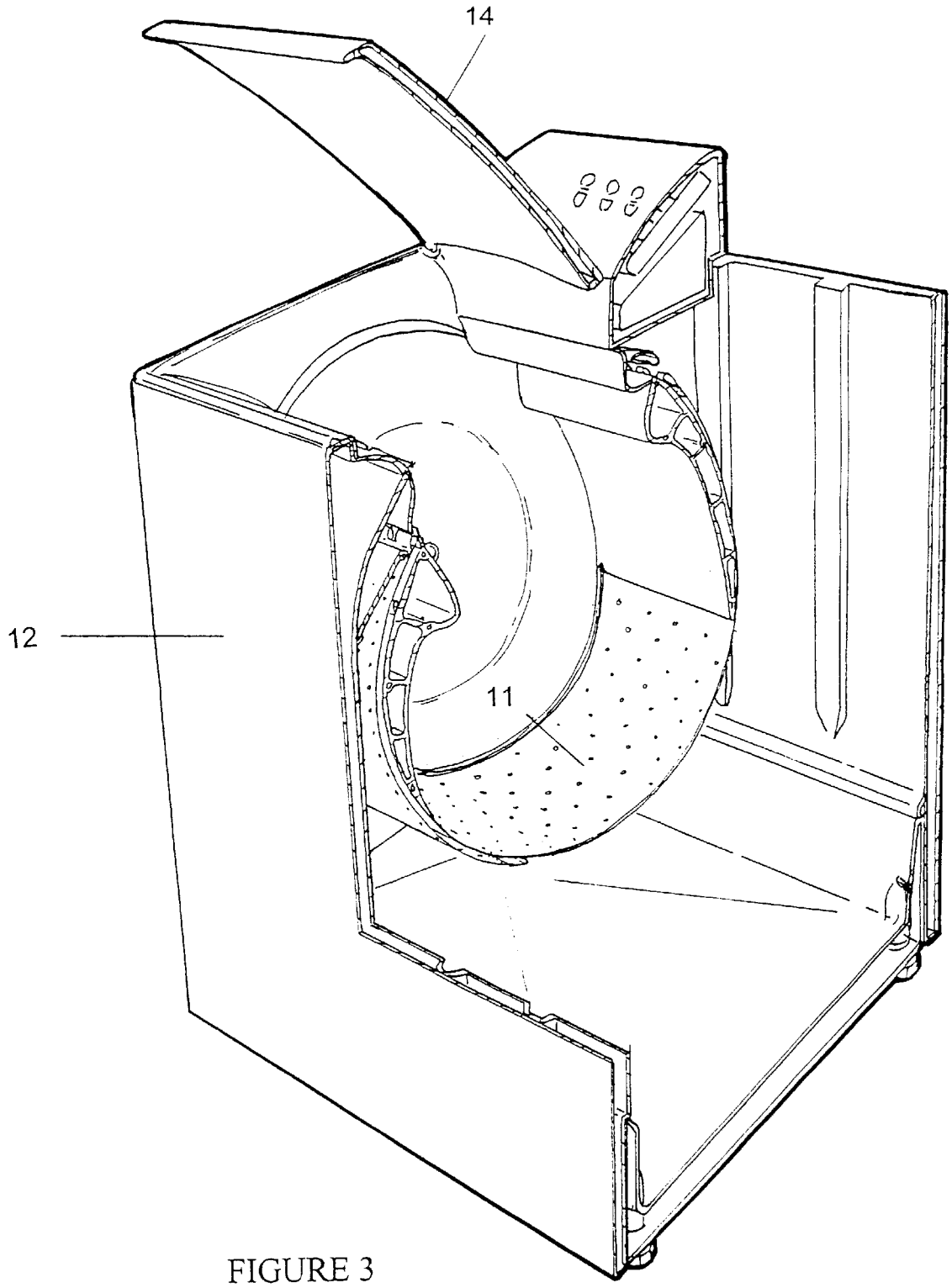
FIG. 3 is a cutaway perspective view of a washing machine according to the present invention with the cutaway to show the machine substantially in cross section.
Figure 4:
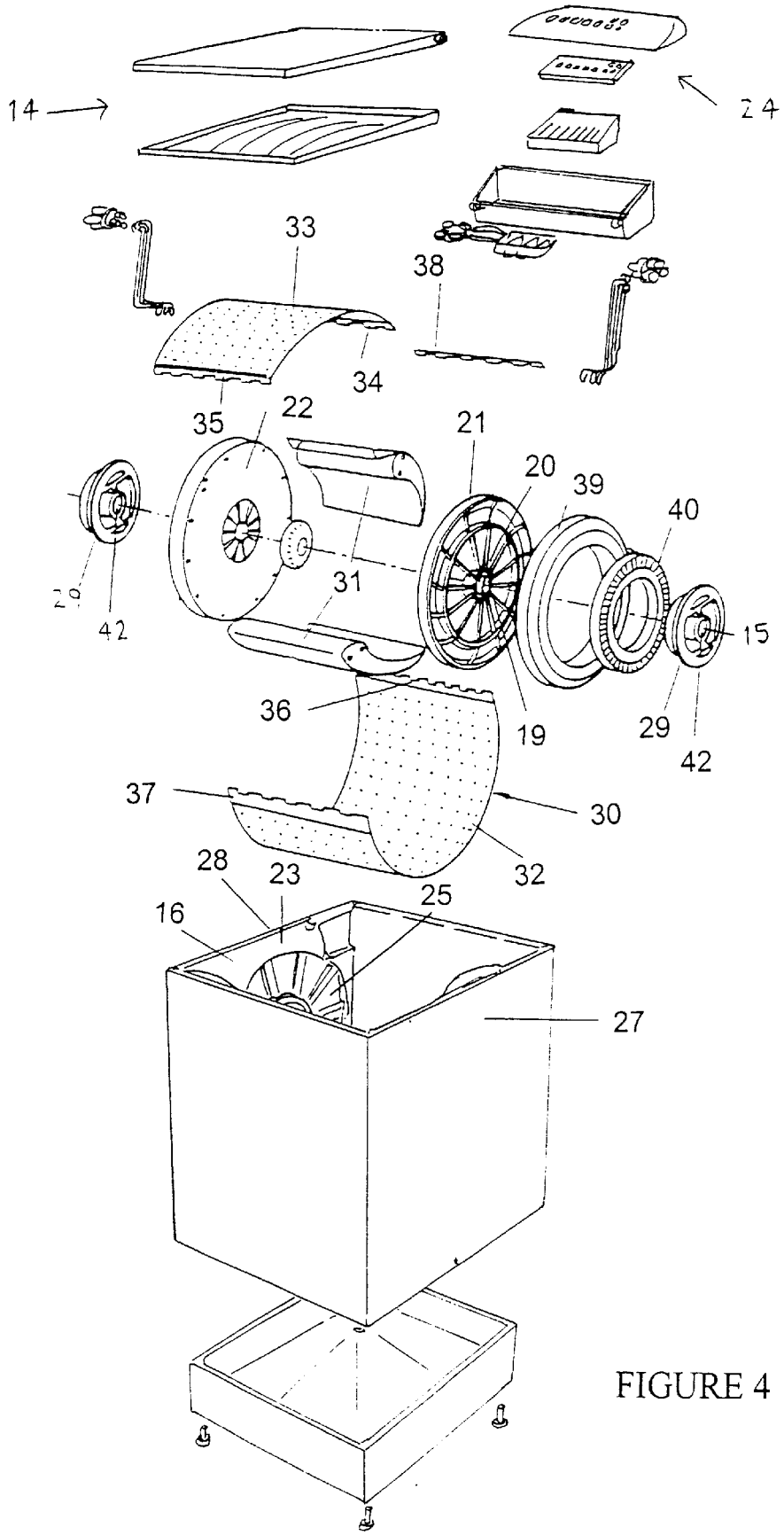
FIG. 4 is an assembly drawing in perspective view of the washing machine of FIG. 3 showing the various major parts that go together to form the machine.

The present invention will be described primarily with reference to a laundry washing machine although many of the principles are equally applicable to laundry drying machines. FIGS. 3 and 4. show a washing machine of the horizontal axis type, having a perforated drum 11 supported with its axis substantially horizontal in side-to-side orientation within a cabinet 12. The cabinet 12 includes surfaces which confine wash or rinse liquid leaving the drum within a water tight enclosure. Some parts of the cabinet structure 12 may be formed together with the liquid confining surfaces by for example twin-sheet thermoforming. In particular the back and side walls of the machine may be formed in this way.

The laundry handling system including the drum and many other components is preferably contained in a top loading configuration. In FIG. 3 the horizontal axis spin drum 11 is contained within a substantially rectangular cabinet 12 with access being provided via a hinged lid 14 on the top of the machine. Other horizontal axis configurations may be adopted.

The drum 11 is rotatably supported by bearings 15 at either end which in turn are each supported by a drum support 16. In the embodiment depicted the bearings are axially located, externally, on a shaft means 19 protruding from the hub area 20 of the drum ends 21,22. Other axial configurations are equally possible, for example internally located in a well in the outer face of the hub area of the drum to be located on a shaft protruding from the drum support. The drum supports 16 are shown each as a base supported unit and have integrated form, which again is ideally suited to manufacture by twin sheet thermoforming, blow moulding or the like. Each drum support preferably includes a strengthening rib area 23 and a drum accommodating well area 25 as depicted to accommodate the respective drum end 21, 22 of the drum 1. The drum supports 16 engage with sub-structure by interlocking within complementary surfaces provided in side walls 27,28. Other less preferable constructions are possible, such as frameworks formed from individual members or mechanical suspension systems.

The drum supports 16 each include a bearing support well at the centre of said well area 25. A bearing mount 29 is located within the bearing support well, and in turn the bearing 15 fits within a boss in the bearing mount 29.

In the preferred embodiment of the invention, as shown in more detail in FIGS. 3 and 4, the drum 11 comprises a perforated metal hoop 30, a pair of ends 21, 22 enclosing the ends of the hoop 30 to form a substantially cylindrical chamber and a pair of vanes 31 extending between the drum ends 21, 22.

In the preferred form of the invention the drum is driven only from one end 21 and consequently one purpose of the vanes 31 is to transmit rotational torque to the non-driven drum end 22. The vanes also provide longitudinal rigidity to the drum assembly 11. To these ends the vanes 30 are wide and shallow, although they have sufficient depth and internal reinforcing to achieve any required resistance to buckling due to unbalanced dynamic loads. Preferably the vanes 30 have a distinct form, including a leading and trailing edge to assist in tumbling the washing load. In the preferred embodiment the vanes 30 are oriented oppositely in a rotational direction, so that under rotation in either direction one vane is going forwards and the other backwards. This vane configuration provides further benefits in providing a user friendly opening into the washing chamber as is described below.

In the preferred embodiment of the washing machine incorporating the invention the drum 11 is supported between a pair of drum supports 16 one at either end thereof. Access to the interior of the drum 11 is provided through a slide away hatch section 33 in the cylindrical wall 30 of the drum. The hatch section is connected through a latching mechanism 34, 35, 36, 37, 38 such that it is connected in a continuous loop during operation. Accordingly the cabinet 12 of the washing machine is formed to provide access to the drum 11 in a substantially top loading fashion, rather than the traditional front loading fashion more common to horizontal axis machines.

The washing machine includes an electric motor (rotor 39 and stator 40 visible in FIG. 4) to effect rotation of the drum during all phases of operation (wash, rinse and spin dry). In the preferred form of the washing machine incorporating the present invention the motor is a direct drive inside-out electronically commutated brushless dc motor having a permanent magnet rotor 39 coupled to one end 21 of the drum 11 and stator 40 coupled to the drum support 16. A suitable form of motor is described in EP0361775.

A user interface 24 is provided, allowing user control over the functions and operation of the machine. The control electronics are integrally contained within the interface module, and provide electronic control over the operation of the machine.

Balancing System

Figure 5:
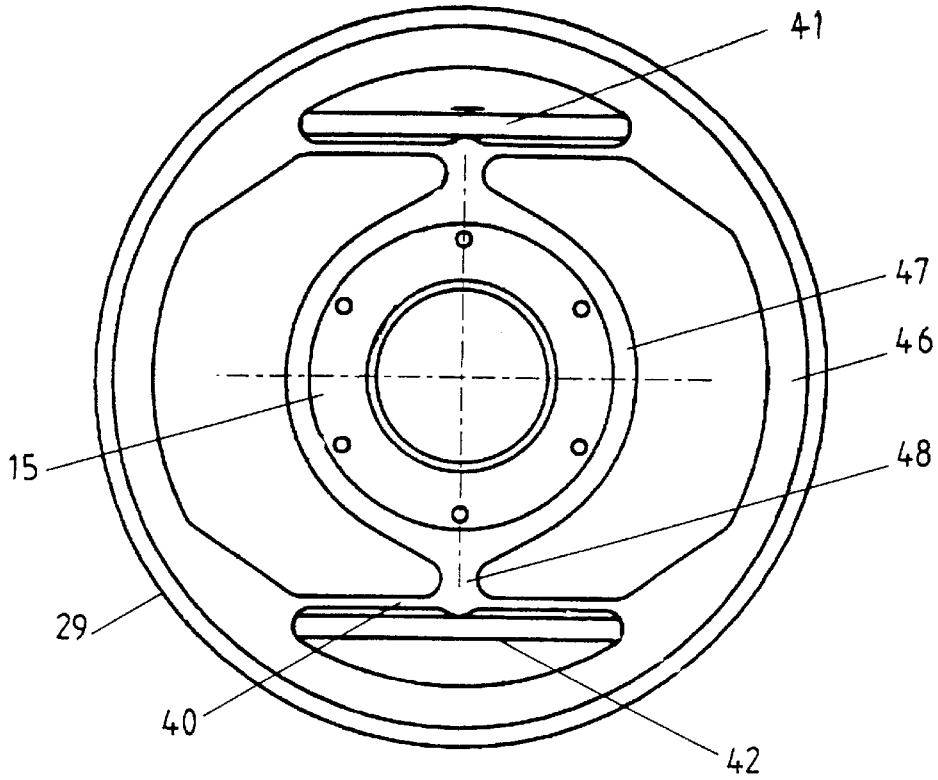
FIG. 5 is an illustration of the drum bearing mount.
Figure 6:
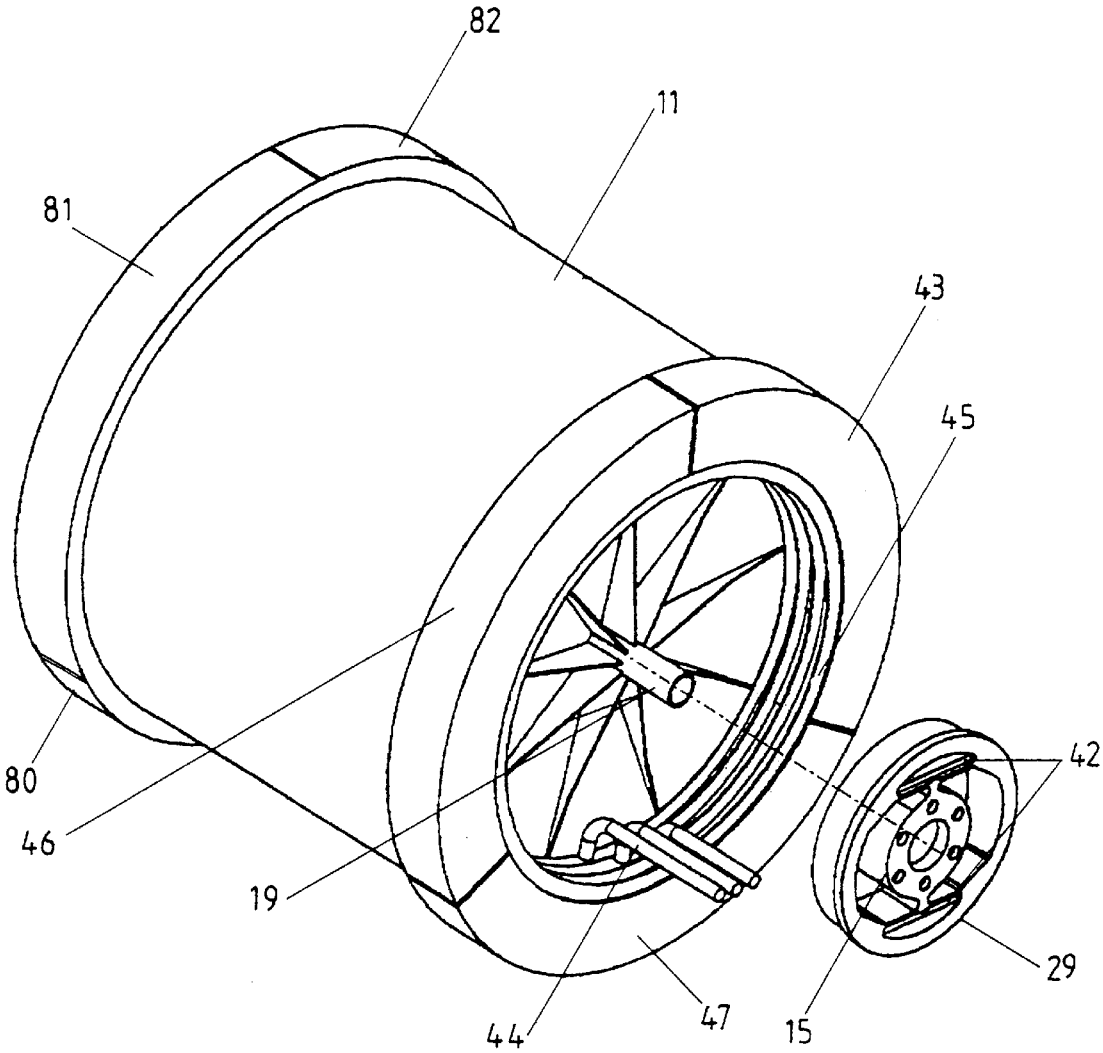
FIG. 6 is an illustration of the drum, showing the balancing chambers and sensors.

In the present invention the forces caused by an out-of-balance load during high speed rotation of drum 11 to affect spin drying are minimised by a dynamically controlled balancing system. This balancing system uses electrical signals generated by the deformation of load cells in the bearing mounts 29 at each end of the shaft 19 to assess the required weight distribution correction that is required to dynamically rebalance the drum 11. Each bearing mount 29 is formed with a pair of bending bridges 40,41 and mounted on each bending bridge is a load cell 42 as shown in FIG. 5. The outputs of the load cells 42 are fed to the control processor of the laundry machine to effect the balancing task, which is achieved by the addition of water to one or more of the six balancing chambers 43,46,47,80,81,82 located in the drum, as shown in FIG. 6. There are three such chambers at each end spaced 120° apart and positioned on the extremity of the drum end 21,22.

Figure 7:
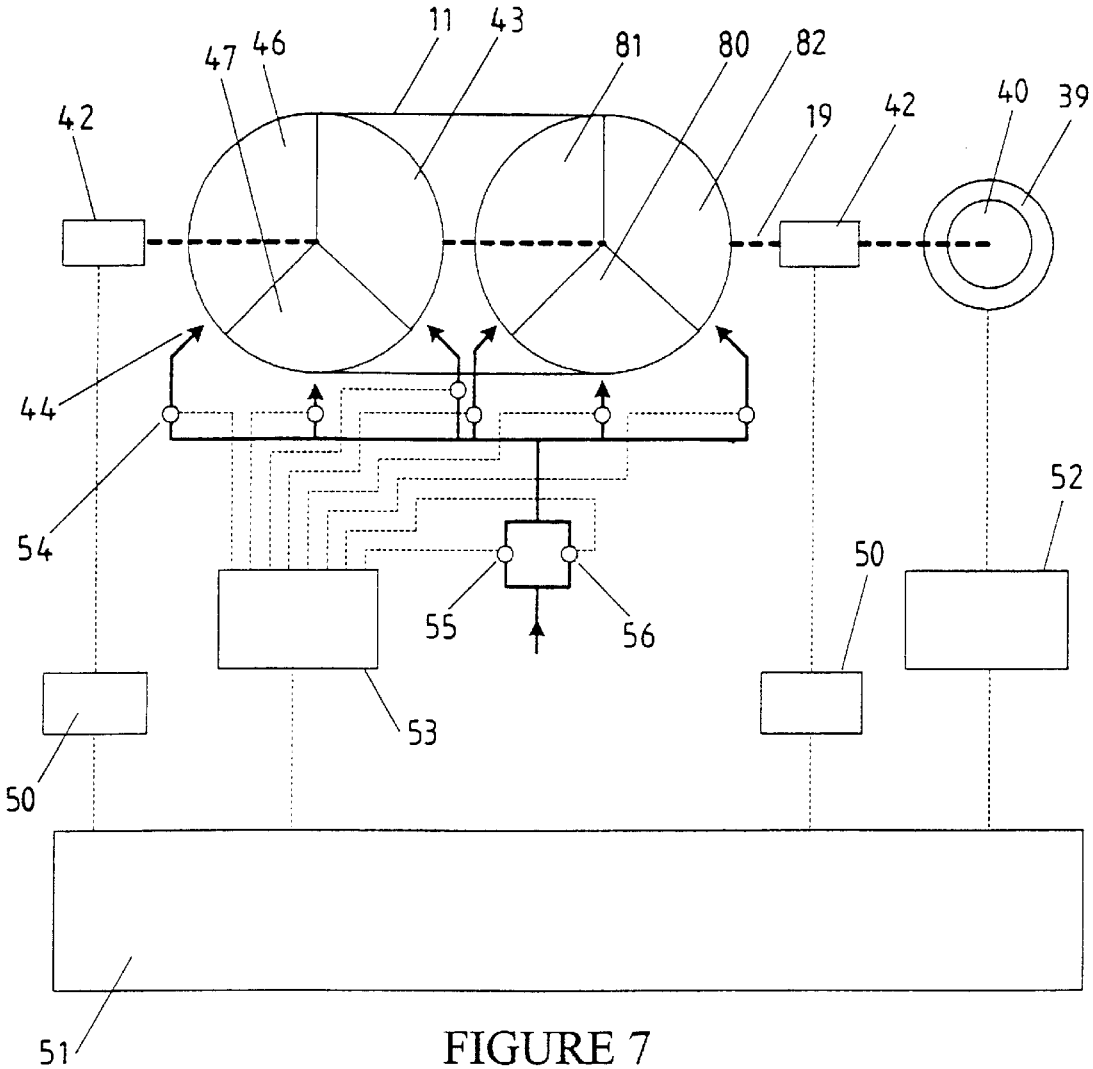
FIG. 7 is a diagrammatic representation of the liquid supply and electrical systems of the washing machine of FIG. 3.

In more detail the balancing system is illustrated in FIG. 7. The output from the load cells 42 is first passed through filtering 50 before connection to the inputs of a microprocessor 51, which may be task specific or the main control processor for the laundry machine. The various algorithms (detailed later) programmed into the microprocessor 51, will dictate spin commands (eg: speed up/slow down) to the motor controller 52 and balancing corrections (eg: open/close valve 54) to the valve driver 53. The motor controller 52 in turn, will vary its energisation of the motor windings to achieve the spin command. The valve driver 53 will open or close the appropriate balancing valve 54, which allows water to flow through the injector 44 into the relevant slot 45 whereupon it is channelled to the appropriate chamber. The valve driver 53 also allows switching between coarse and fine control modes by switching the water flow through the high 55 and low 56 flow rate valves respectively.

To correct an imbalance, it is necessary to artificially add equal and opposite static and dynamic imbalances. To add a static imbalance only requires to add a certain amount of mass at some radius and rotation angle (or 'phase' angle), at the same location along the spin axis as the CoG. However, to add a dynamic imbalance requires to add two equal and opposite imbalances at two locations along the spin axis that are evenly spaced either side of the CoG. The end result is that both static and dynamic imbalances can be corrected by adding, at two separate locations along the spin axis, two independent masses (both may be at the same radius) at two independent phase angles. There are four variables to be defined, and so four useful pieces of information about the nature of the imbalance must be obtained.

These pieces of information are typically obtained by measuring either acceleration, velocity, force, or displacement at two independent locations on the vibrating system. The reason that only two sensor locations are required and not four is that because the relevant signals are sinusoidal in time and therefore contain two pieces of information. One is the magnitude of the signal, and the other is the "phase" angle with respect to some reference point on the spinning system.

Once the signal magnitude and phase angle at two independent locations are acquired, a method is required to calculate the two masses and their phase angles with which to correct the imbalance. This is done by representing the signal data and mass data as vectors of two complex numbers, and the relationship between them as a square matrix of four complex numbers. This matrix, when for mapping the mass vector to the signal vector, is called a response matrix, and it is its inverse that is used to map the signal vector back to the mass vector representing the imbalance.

The technique for acquiring data on the imbalance is difficult to implement in practice. This is because some types of signal are more difficult to measure than others, and even if good signals are obtained, the response matrix can become a unpredictable and difficult thing to know (or learn) depending where the signals are measured. In the preferred embodiment of the present invention the imbalance is characterised using force or stress measurement. Of the available alternatives force is easy to measure and the signal level is quite adequate at low speeds.

Because the machine has no suspension the cabinet is effectively rigidly connected to the spin axis of the drum. This means that the response matrix that relates imbalance to force at the bearing assemblies is reasonably diagonal and does not vary in a complex and/or unpredictable manner with speed where the appliance is supported on a rigid floor. Thus a radial component of force (vertical for instance) at the bearing assemblies at each end of the drum, is the most useful signal to measure for the purpose of balancing, with a rigid floor. Where the floor supporting the appliance is flexible a different relationship applies, which is discussed later.

Sensors

To perform a complete static and dynamic balance requires four useful pieces of information to be known about the nature of the imbalance. It has also been shown that the desirable signals for the purpose of balancing are a radial component of force at each bearing assembly supporting the drum, and thus two load cells of some sort are required. In the preferred embodiment a pair of sensors 42 are located at either end of the shaft 19 as shown in FIG. 4.

A strain sensor suited to this application is the piezo disc. This type of sensor produces a large signal output and so is not significantly affected by RFI. However a piezo strain sensor can only measure fluctuations in load due to charge leakage across the disc.

The piezo disc will have a particular response in relation to applied force. Since force is proportional to frequency squared and the response magnitude is proportional to force frequency, the relationship between sensor output and rpm of the drum is cubic.

In more detail the bearing mount looks like two concentric cylindrical rings 46, 47, as illustrated in FIG. 5. The load bridges 40, 41 described previously are connected at the top and bottom of the inner zing 47, respectively, and to opposite parts of the upper periphery of the outer ring 46. A piezo disc 42 is adhered to the loading bridge onto the side facing the outer ring. The load from the drum is taken through a bearing 15 mounted in the internal ring 47, through the load bridges 48 and load cell 42 into the outer ring 46, and out into the external structure. It will be appreciated that in this fashion the load bridges will flex according to any vertical forces from the spinning of the drum, thus deforming the piezo disc and providing a signal representative of the imbalance force.

Dynamic Control

In the preferred embodiment of the invention a dynamic control method is used. This is not in any way to be confused with static and dynamic imbalance as explained earlier, it simply refers to the nature of the control methodology. The alternative control methodology is 'static'. A static control method does not make use of or retain data on the time dependent behaviour of its target system. As a result the method is executed as a 'single shot' attempt to restore equilibrium, and sufficient time must be allowed to lapse after each execution so that the system has returned to a steady state condition prior to the next execution. Whereas a dynamic control method can anticipate the time dependent behaviour of the system and by storing recent past actions it is able to continuously correct the system, even while the system is in transient response.

The main advantage of the preferred dynamic control is that the control loop is able to adjust for discrepancies as and when they appear rather than having to wait for the next execution time to come round. For systems with slow time response this is a considerable advantage. To work effectively the controller must be programmed with an estimate of the time dependent response of the target system. However, provided it has no significant quirks, this only needs to be roughly approximated and the approach will still work well, Also, because the dynamic controller runs on a fast decision loop, any noise on the input parameters will result in many small corrections being made that are completely unnecessary. For this reason a minimum threshold correction level must be established where there is any cost or difficulty associated with effecting a correction.

Listing the main sources of time dependent behaviour:

Given an instantaneous change in balance state of the machine, it will take a few revolutions to reach a steady state of vibration.

The forgetting factor averaging on the load cell data acquisition means that the averaged data also takes a number of revolutions to respond to a new vibration state.

Change in balance state of the machine is never instantaneous; water addition requires anything from 0.1 to 60 seconds.

Water extraction from the load means the balance state of the machine may change quite rapidly as its spin speed ramps up.

If in the spin cycle the machine is to ramp from 100 to 1000 rpm in about 3 min then the machine will almost certainly be in a state of transient response for the duration of this period. Consequently the controller must be able to respond to changes in the balance state of the machine without the machine ever being in a steady state condition.

As previously stated for dynamic control to be implemented the present controller must be programmed with an approximation of the time dependent behaviour of the machine. More precisely it must know how much to weight its past actions (as a function of how long ago they were made) when deciding on what corrections, if any, are to be implemented. In this application, for each water chamber the sum of the appropriately weighted past history of water addition can be considered to be 'Effect in Waiting'; i.e. the controller is still anticipating that the effect of a certain quantity is still to come through on the signals, and thus must subtract his 'Effect in Waiting' from the presently calculated water requirements when deciding which valves should be on and which should be off at present.

Figure 9:
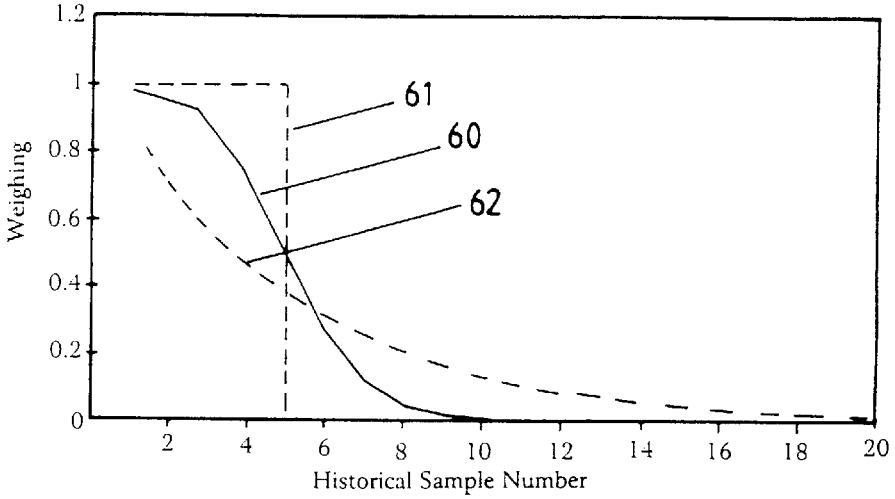
FIG. 9 is a graph illustrating the weighting curves.

To do this accurately requires a complete record of the controllers past actions for as many points back as it needs to remember, and a table of weighting values for as many points, which in this application will be at least ten. If we call this number of points N, then to store the history of six control output channels with N points each requires 6N data points. Also, to then calculate the effect of this history will require 6N multiplications. One simplification would be to approximate the exact weighting curve 60 with a 'table top' curve 61 as shown in FIG. 9. This then eliminates the need for a stored table of weighting values, and reduces the 6N multiplications to 6N additions, but even this is still to complicated. A very crude approximation of the exact weighting curve is the negative exponential 62 also shown in FIG. 9. While this sounds complicated it is in fact extremely easy to achieve, it is simply a forgetting factor type average. All that needs to be done is this: for each water control channel, create an effect in waiting variable and each time the control loop executes multiply it by a certain factor (between zero and one) and add to it some increment value if the water control valve for this channel was on during the last loop. Computationally all that is required is six multiplications and six additions with each control loop execution; a vast saving. To avoid the need to have different forgetting factors dependent on speed, the control loop must be executed on a per revolution basis. This is simply achieved by executing the balance control code with the once per rotation sensor, directly after the data acquisition conversion code. Of course all quantities of water must now be calculated in terms of revolutions at the present speed rather than time, but this is a simple matter in that the magnitude calibration factor will now vary like rpm rather than rpm squared.

Figure 10:
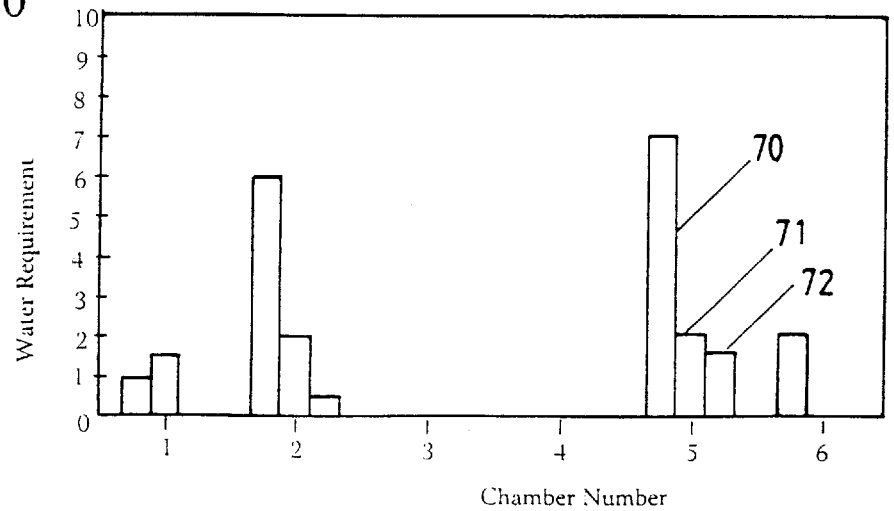
FIG. 10 is an illustration of the decision making process regarding filling of the balancing chambers.

Another point to consider is that, considering one end at a time, if the out of balance load is directly opposite one of the chambers (say chamber number 43) then the data acquisition routine will identify this chamber as the primary one needing water, however, due to noise on the signals, it will almost certainly also say that one of the other chambers needs a small amount of water as well. This second water requirement will be much smaller than the other one and will sometimes be chamber 46 and sometimes chamber 47 depending on just what the noise was in the last few revolutions. If the balance control routine addresses these secondary small water requirements then over the relatively long period of addressing chamber 43 it will also gradually fill chambers 46 and 47, thus negating some of the water going into chamber 43, and leaving less headroom for further balancing corrections later on. Clearly the balance controller must not address two chambers at once at one end unless it is clear that neither of them could be due to noise, i.e. both of them require a similar amount of water. Similarly because the ends of the machine are not truly independent systems but are weakly coupled (as will be discussed later) then large out of balance forces at one end cause 'ghost images' at the other, thus the balance controller must not address two ends at the same time unless it is clear that neither of them could be ghost images, i.e. both ends require a similar amount of water. The easiest way to address both of these problems is identify the maximum water requirement out of the six chambers and to then set a dynamic 'noise' threshold equal to half of this value of water (as shown in FIG. 10). A water valve (e.g. 5) is then only turned on if the result 72 of its present requirements 70, minus its present effect in waiting 71, minus the noise value, is greater than the increment value mentioned above. It is here that we perform our magnitude calibration by adjusting this increment value.

Finally, a small amount of hysteresis is necessary to prevent repetitive short valve actuations. This is simply achieved by using the above criterion for deciding when to run a valve on, but using a different criterion when deciding when to turn it off again. The off criterion is more simple: a water valve is only turned off once its present requirements is less than its present effect in waiting. In other words once the valve is on it is not turned off until its chamber requirements are addressed.

Control Algorithms

The task of spinning while balancing actively can be subdivided into three sub-tasks or algorithms:

Imbalance Detection Algorithm (IDA)

Balance Correction Algorithm (BCA)

Spin Algorithm (SA)

Figure 11:
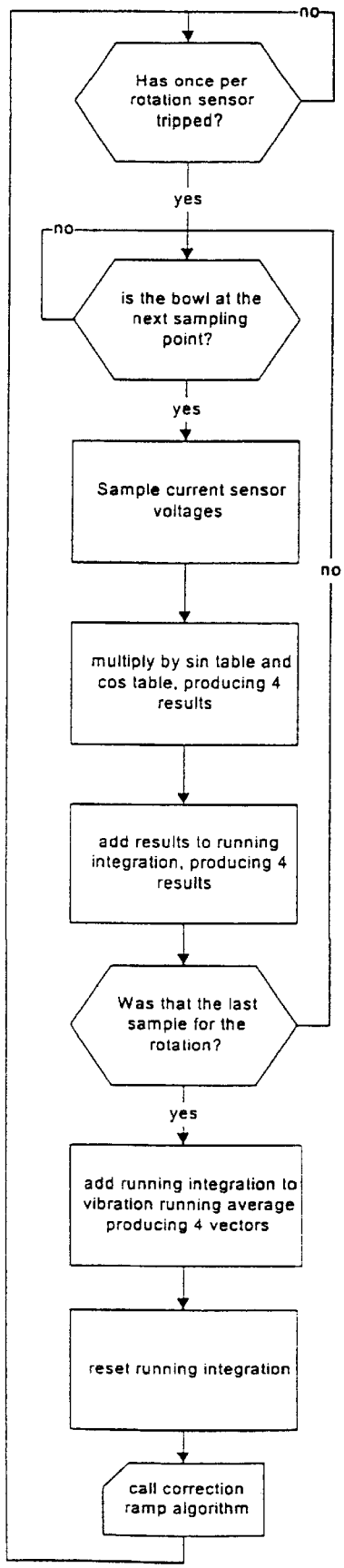
FIG. 11 is a flow diagram showing the Imbalance Detection Algorithm.

The Imbalance Detection Algorithm (IDA) (shown in FIG. 11) is concerned solely with the acquisition of imbalance related data, and is embedded in the motor control routine. It is active whenever the motor is turning, and makes its results available for the Balance Correction Algorithm (BCA) to see.

Figure 13:
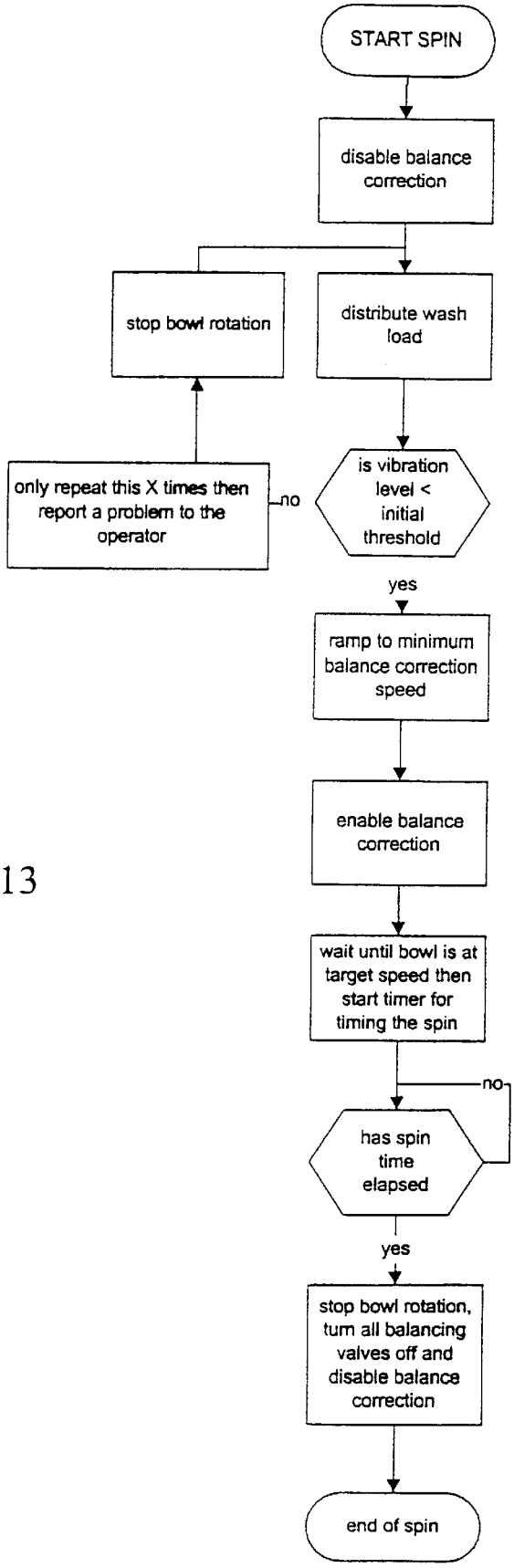
FIG. 13 is a flow diagram showing the Spin Algorithm.

The Spin Algorithm (SA) (shown in FIG. 13) is concerned solely with executing the spin profile asked of it. It ramps the speed of the machine according to the profile requested and the vibration level determined by IDA.

BCA (shown in FIG. 12) is concerned solely with correcting whatever imbalance IDA has determined is there. It is an advanced control algorithm that takes into account the time dependent behaviour of both the machine and IDA. BCA is active whenever the rotation speed of the machine is greater than approximately 150 rpm.

Signal Analysis—IDA Processing

To determine the imbalance in the load requires the magnitude and phase angle of the once per rotation sinusoidal component in each of the signals. Unfortunately the signal does not look like a clean sinusoid, but is messy due to structural non-linearities in the machine as well as Radio Frequency Interference (RFI). The once per rotation component or 'fundamental component' must be somehow obtained out of such a signal.

This is done by digitally sampling the signal and using the discrete Fourier Transform technique. It is not necessary to compute an entire transform, which would give us half as many frequency components as we have signal samples inside of one revolution (and would also take some time in an 8-bit microprocessor), but just the fundamental component. The way this is done is to multiply each of the signal data points obtained by the value of a once per rotation cosine wave at the equivalent phase angle lag after the rotational reference mark, and sum each of these results over a whole revolution, and then divide by the number of results. This gives the real (or x) component of the complex number result. The imaginary (or y) component is derived using the same technique but using a sin wave instead of a cosine wave. The resulting complex number may then be converted in polar form, giving magnitude and phase angle of the fundamental component in the signal. Also to prevent aliasing the input signal is passed through an analogue filter first to remove frequency components higher than half of the sampling frequency.

Figure 8:
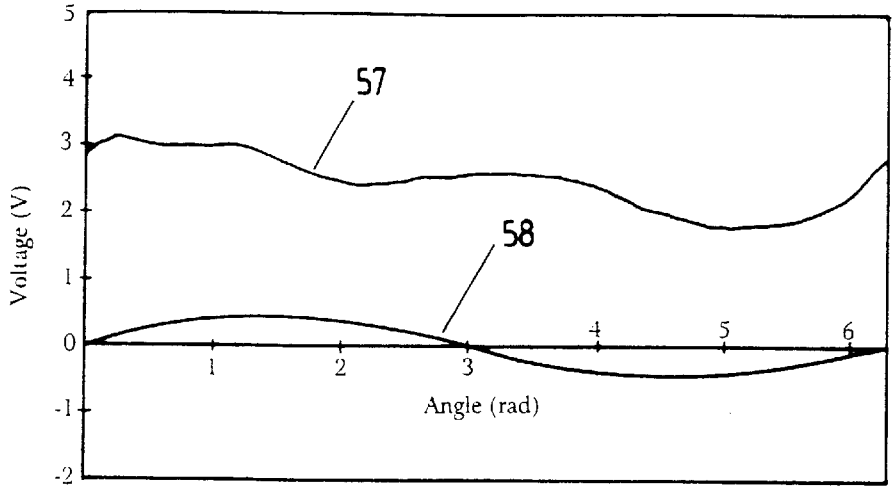
FIG. 8 is a waveform diagram giving example output waveforms from the vibration sensors.

The discrete Fourier analysis may be made considerably more simple if the sampling is performed using a fixed number of samples per revolution rather than a fixed frequency. This of course requires a rotary encoder, which in this application is already provided in the form of a DC Brush-less motor. It is therefore necessary to use a number of points per revolution that divides exactly into the number of commutations per revolution executed by the motor. This also enables the sine values that will be required to be pre-programmed as a table (termed the 'sine table'), from which the cosine values may be obtained by offsetting forwards by a quarter of the number of samples per period. It is necessary to have a reasonable number of sampling points per revolution so that the order of harmonics that are aliased onto the fundamental component is well beyond the cut-off frequency of the low pass filter. This means that the number of sampling points must be at least 12 to obtain reliable sampling at speeds upwards of 200 rpm. An even number of points per revolution for sampling should be used so that the sine table is perfectly symmetrical, i.e. the positive sequence and the negative sequence are identical apart from their sign. This ensures that the DC offset on the input signal does not influence the fundamental component. FIG. 8 illustrates the signal after filtering 57 and the extracted fundamental component 58.

Alternatively, if a more powerful microprocessor is employed then by maximising its data acquisition capabilities the noise problem will be further reduced. This would mean instead of fixed sampling on a per revolution basis, it would be on a fixed frequency basis—at a higher rate. Further, the sine and cosine valves could be either calculated or interpolated from a table, which simplifies much of the calculations.

Once the fundamental component of the source signals is obtained it will inevitably contain some noise component (i.e. consecutive measurements will have some variance). The best way to get rid of this is to ensure that the signal source is accurate, clean, and has linear response. Once the source end has been addressed then averaging techniques may be used to address the remainder of the noise.

One such technique is to implement a 'Forgetting Factor'. This is where every time a new measurement is acquired the new average is equal to for example 70% of the old averaged value plus in this case 30% (=100%−70%) of the new measurement. Here the forgetting factor used was 0.3 since 0.3 of the old average is forgotten and replaced it with 0.3 of the new measurement. This form of averaging suits microprocessor based application since it is inexpensive with respect to both memory space and processor time.

The main disadvantage with averaging the measurements is that the response time of the imbalance detection goes down. This is simply a result of the fact that the averaged result must incorporate several measurements in order to reduce the noise, which of course can only be obtained from past measurements, not future ones. The lower the forgetting factor, the more the averaged value remembers from past measurements, and thus the slower it responds to a change in the machine's vibration.

Because the balancing can only be executed over many iterations (due to water extraction from the load) it is not necessary to be able to obtain a perfect balance in one 'hit'. From this point of view it is then acceptable to make a few 'approximations', the biggest of which is to treat the machine as two independent single degree of freedom (SDOF) systems associated with each signal source. The main advantage of doing this is that the micro does not have to calculate and invert the 2×2 response matrix, it only has to estimate the two SDOF responses for each end.

Since the measurement data are complex numbers in Cartesian format (x & y), whereas the responses are in polar format (magnitude & phase), a format conversion and complex division is required at each end to obtain the water correction vector While this is not impossible to execute conventionally, there is a more simple approach: take the phases of the response and incorporate them directly into the discrete Fourier technique as offsets each of an integer number of points when referencing the table of sine values. These offsets may then adjusted as the machine changes speed for phase angle calibration. Alternatively phase calibration may be performed using a rotation matrix acting on the vectors as calculated without any applied offset to the sine table. Magnitude calibration however, is performed later in the dynamic control routine.

Once having obtained the x and y components of the imbalance at each end of the drum, it is then required to calculate how much water each chamber at each end needs since the chambers are 120 degrees apart. If the chambers were 90 degrees apart, (i.e. orthogonal like the x and y axes) then the problem would be trivial, but this would require four chambers for each end and thus two more water control valves and associated drivers than necessary. A more simple approach is to calculate the projection of the signal vector onto axes that are 120 degrees apart, the same as the chambers.

The way to implement this is very simple. The Fourier technique uses sine and cosine wave forms to extract the orthogonal x and y projections. This follows quite naturally from the fact that a cosine wave is a sine wave that is has been shifted to the left by 90 degrees. Therefore to split the signal vectors into projections that are 120 degrees apart simply requires to replace the cosine wave form with a sine wave form that has been shifted to the left by 120 degrees, i.e. one third of a rotation.

The phase calibrated signals now represent the projection of the imbalance onto the first two chambers. To obtain the projection of the, imbalance onto the third chamber to be may use the vector identity that the sum of three vectors of equal magnitude and all spaced 120 degrees apart must be equal to zero. Hence the sum of all three projections must be zero, i.e. the projection onto the third chamber is the negative of the sum of the projections onto the first two chambers. By adding half a rotation to the response phase angles the three values obtained are made to represent the projection of the restoring water balance required onto each balancing chamber.

Finally, at least one of these three projections will be negative, representing water to be removed from that chamber. This cannot be done and so we simply add a constant to all three numbers so that the most negative number becomes zero and the other two are guaranteed positive.

Overall Control Strategy—SA

The overall control over the spin process is assigned to the spin algorithm SA. It begins with the bowl speed at zero, and disables the BCA. Its first task is to better distribute the wash load to allow spinning to begin. If at a very low spin speed the vibration is below the initial threshold, it is allowed to spin to the minimum BCA speed at which point BCA is enabled. If the vibration is not below the threshold, redistribution is retried a number of times before stopping and displaying an error message. Once BCA has attained the target level of spin speed the spin is allowed to continue for the desired period after which the bowl is stopped, valves are closed and BCA is disabled.

Dynamic Balancing—BCA

Figure 12:
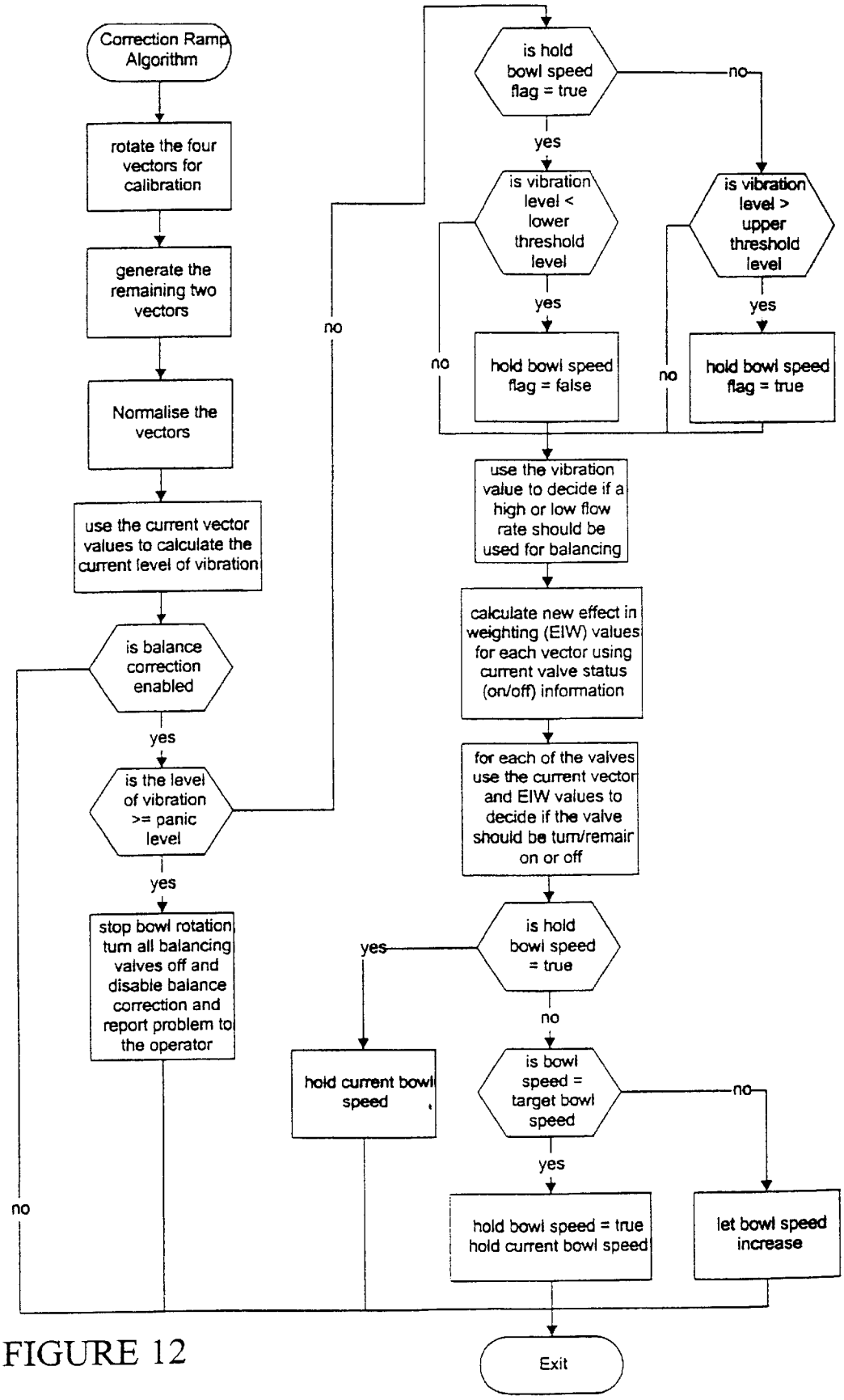
FIG. 12 is a flow diagram showing the Balance Correction Algorithm.

In more detail the balance correction algorithm shown in FIG. 12 begins with calibration of the phase information from the IDA. The step of vector rotation is optional depending on the method used (alternative is to apply in offset to the sine table). Following this the vectors are normalised and the level of vibration is calculated. If the enable flag is true and the level of vibration is below a predefined critical limit the decision making process begins. Firstly the vibration level is compared to a number of threshold values to assess whether to enable increase of the bowl speed. Then depending on the level of vibration fine or coarse (low or high flow rate to valves) correction is enabled. The effect in waiting of past actions is then updated, and together with the current vector information and the status of each valve a decision is made whether to open or close each valve. Then if the hold bowl speed flat is not enabled i.e. acceleration is allowed, and the speed is not currently at the desired target level, the bowl speed is allowed to increase to the target level. At this point it loops to the start and begins another iteration, effectively continuously correcting and accelerating until it reaches the target speed.

Further Improvements

It will be appreciated in the preceding embodiments that the washing machine is assumed to be supported on a rigid surface such as a concrete floor. Where this is not the case, for example, wooden floors, and the entire washing machine is permitted substantial displacement during the spin cycle, then those techniques previously described will not be entirely successful. Therefore, in a further improvement the present invention also provides a method and apparatus for correcting for spin imbalances when the washing machine is supported on a non-rigid support surface.

Figure 14:
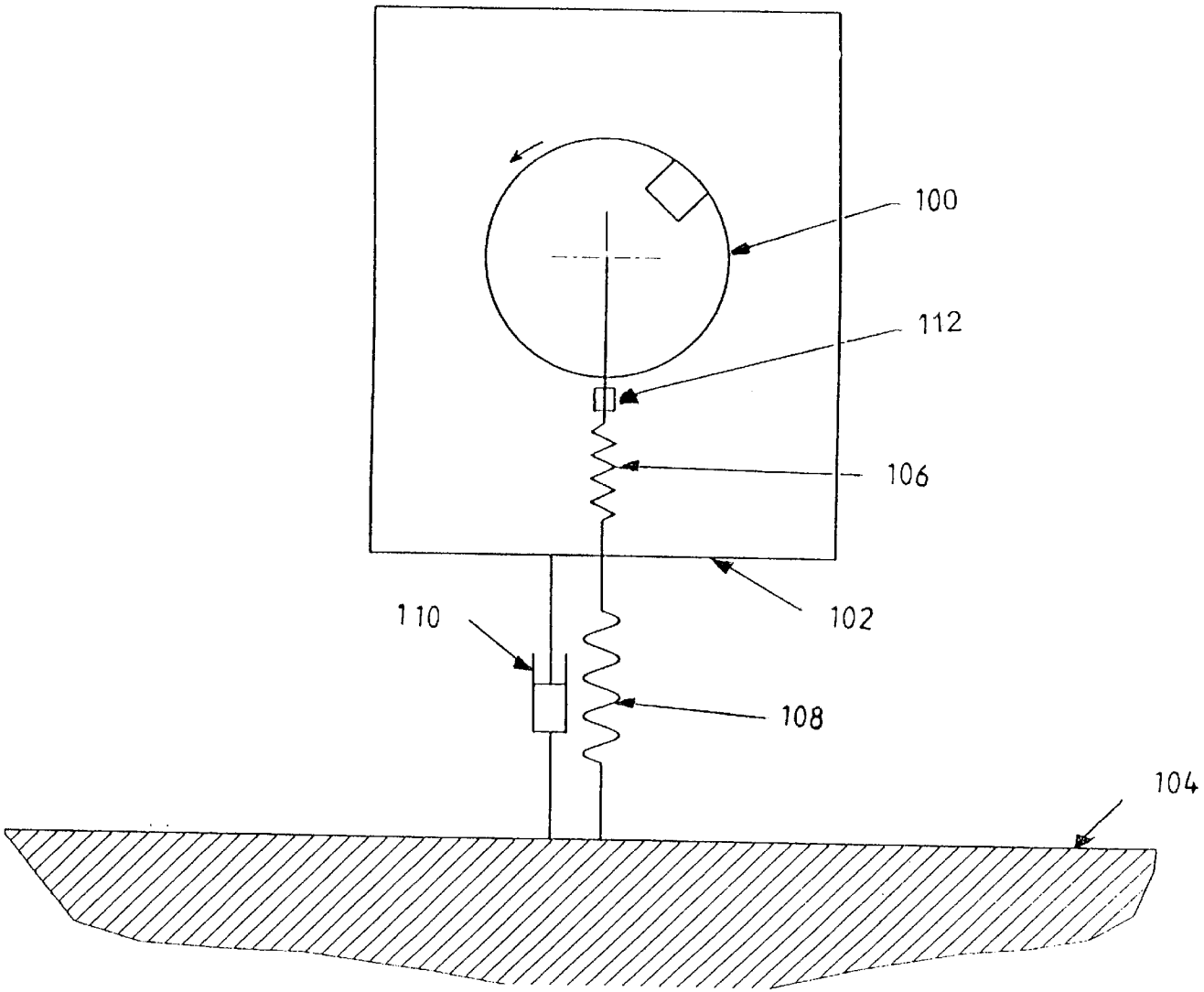
FIG. 14 is a block diagram of the equivalent spring system when the laundry appliance is supported on a flexible floor.

The equivalent spring system which represents the spin drum 100, the machine frame 102 and the reference surface is shown in FIG. 14. The first spring 106 between the spring drum 100 and the machine frame 102 effectively represents the elasticity of the load bridge which connects the bearing mount to the drum support or frame of the washing machine. This bridge also forms the basis of the load cell which measures the forces between the drum and the frame of the washing machine. The second spring component 108 in this case represents the elasticity of the support surface, for example, flexible wooden floorboards. The second spring 108 is complex and includes a damping component 110. In order to measure the acceleration or displacement of the drum 100 relative to the reference surface 104, i.e. a stationary reference point, a accelerometer 112 is connected either to a non-rotating part of the bearing itself or on an adjacent section of the load cell bridge.

Now, consider that the machine is spinning at a particular speed and is in a perfectly balanced state. Suppose we now add a small "Out Of Balance" ($F_{O/B}$) load at one end (by injecting some water into one of the balance chambers). If the ends of the machine behaved entirely as independent mechanical systems then we would expect that we would now measure a force vector at the end to which we added water, and that nothing would change at the other end: the other end would remain perfectly balanced. However, the ends of the machine are not independent systems, and in reality we find that we now measure a force vector at both ends of the machine. The two ends are said to be 'coupled' together. As a result of this coupling, the observed force vector at one end of the machine is related not-only to the "out of balance" $F_{O/B}$ vector at the same end, but it is also related to the $F_{O/B}$ vector at the other end of the machine. Thus:

$$F_1=R_{11}*F_{O/B1}+R_{12}*F_{O/B2}$$

Where $F_1$ is the force vector measured at one end 1 of the machine, $F_{O/B1}$ and $F_{O/B2}$ are the $F_{O/B}$ vectors at ends 1 and 2 respectively and $R_{11}$ and $R_{12}$ are the individual response factors that $F_{O/B1}$ and $F_{O/B2}$ have at end 1. (Note that $R_{11}$ and $R_{12}$ are also vectors; each consisting of magnitude, and phase lag of the response)

Similarly at end 2 we may write $$F_2=R_{21}*F_{O/B1}+R_{22}*F_{O/B2}$$

Where $F_2$ is now the force vector as measured at end 2 and $R_{21}$ and $R_{22}$ are the individual response factors that $F_{O/B1}$ and $F_{O/B2}$ have at end 2.

These two equations may be mathematically combined as a Matrix equation:

$$F=R*F_{O/B}$$

Where F is the column vector (of vectors)

$$\begin{bmatrix} F_1 \\ F_2 \end{bmatrix}$$

$F_{O/B}$ is the column vector (of vectors)

$$\begin{bmatrix} F_{O/B1} \\ F_{O/B2} \end{bmatrix}$$

R is the response matrix (of vectors)

$$\begin{bmatrix} R_{11} & R_{12} \\ R_{21} & R_{22} \end{bmatrix}$$

Now, if the machine held the bowl absolutely rigid while spinning then we would expect the force transducers to measure precisely the force vectors required for the centripetal acceleration of the $F_{O/B}$ load vectors. But this is not the case. The external structure of the machine is not infinitely stiff, and neither is the floor, the house, or even the ground under the house for that matter. As a result the force transducers also measure a component due to the mechanical response of the machine which is a function of all of the above (machine structure, floor, house . . . ), and also of bowl rotation speed. Note that it is this extra component of machine response that makes the coupling terms in the matrix ($R_{12}$ and $R_{21}$) significant and the whole matrix in general impossible to pre-calibrate.

It is here that two possible techniques emerge:

1) By measuring acceleration vectors at each end we may determine the machine's mechanical response, and then by appropriately combining force vector and acceleration vector at each end we can make a new vector quantity for which the response matrix is uncoupled (i.e. $R_{11}$ and $R_{22}$ are the only significant terms). Further the matrix is not a function of unknown parameters and thus can be factory calibrated.
2) Or by making small, but known, changes to the $F_{O/B}$ vectors and measuring the resultant change in force vectors, it is possible to learn this response matrix 'R' during the spin cycle.

The first technique is very robust, but requires the addition of acceleration sensors to measure absolute vertical acceleration of the drum.

The second technique is very clever, but has several difficulties associated with it which are outlined further on.

First Method—Acceleration Measurement

From the system described above it will be apparent that the force measured by the load cell will not be an accurate measure of the imbalance. In order to determine the imbalance to correct the controller must take account of the effect of the complex system external to that of the washing machine. It will be appreciated therefore that the absolute force $F_a$ acting on the spin bowl can be expressed as $$F_a=m_1\times a_a$$

where $m_1$ is the mass of the spin drum and $a_a$ is the absolute acceleration of the drum, as measured by the accelerometer. This force in turn is then composed of:

$$F_a=F_{o/b}+F_1$$

where $F_{o/b}$ is the out of balance force and $F_1$ is the force measured by the load cell. By rearrangement the out of balance force $F_{o/b}$ may be expressed in terms of known variables $$F_{o/b}=(m_1 \times a_a)-F_1$$

and calculated by the controller. Whereas $F_1$ would be available from IDA as previously described, the output of the accelerometer would need to be put through a similar filtering process to the IDA, in order to provide a useful signal. The drum mass $m_1$ is estimated based on the known weight of the drum, the amount of water added to the load and known characteristics of the load based on the "type" of load. The "type" of load may be determined using any one of a number of well known fabric sensing techniques such as that disclosed in our U.S. Pat. No. 4,857,814.

The above makes the assumption that each end of the drum may be treated separately. We have found that by using this method this is a satisfactory assumption. However in some cases this may not be adequate and therefore a more accurate system may be required. In this case it is necessary to take into account the coupling between each end of the drum. To this end a coupling matrix $\gamma$ may be determined by successive tests on the system, where $\xi$ is the ratio of the position of the centre of gravity to the length of the drum, and $\alpha$ is the inertia factor.

$$\alpha = \frac{I}{m_1 l^2}$$

$$\underline{\gamma} = \begin{bmatrix} (1-\xi)^2+\alpha & (1-\xi)\xi-\alpha \\ (1-\xi)\xi-\alpha & \xi^2+\alpha \end{bmatrix}$$

from this we may calculate the out of balance force:

$$\underline{F}_{o/b}=\underline{\gamma} m_1 \underline{A}+\underline{F}_1$$

where the acceleration vector A may be represented $$\underline{A} = \begin{pmatrix} a_1 \\ a_2 \end{pmatrix}$$

and the force measure of the load bridge $F_1$ as $$\underline{F}_l = \begin{pmatrix} F_{l1} \\ F_{l2} \end{pmatrix}$$

Second Method—Determining the System Response

Whereas previously:

$$F=R*F_{O/B}$$

If the response of the machine is relatively linear $$dF=R*dF_{O/B}$$

Where dF and $dF_{O/B}$ are still 2*1 column vectors, and R is the 2*2 response matrix. dF represents the change in the force vectors as a result of adding $F_{O/B}$ vectors $dF_{O/B}$. However, in the real world we will want to find out the $F_{O/B}$ vectors needed to remove the F vectors measured. To do this we need to rearrange by multiplying each side by the inverse of R:

$$\text{inv}(R)*dF=\text{inv}(R)*R*dF_{O/B}$$

Yielding $$dF_{O/B}=\text{inv}(R)*dF$$

Since any matrix times it's inverse gives the identity matrix. Let us also call the inverse of R 'A' since it is really the 'action' matrix that tells us what to do given what we measure. Thus:

$$dF_{O/B}=A*dF$$

Where A=inv(R)

The problem is we want to find out A. The way to do this is to add a small, but known, additional imbalance to one end and nothing to the other. Let us denote the addition as $dF_{O/Ba}$, and the corresponding changes in the force vectors as $dF_a$. Remember $dF_{O/Ba}$ and $dF_a$ are both column vectors (of vectors). Now repeat the exercise but this time adding another small addition to the other end. This time let us denote the addition as $dF_{O/Bb}$, and similarly the corresponding change in force vectors $dF_b$. Now we can combine the two experiments together to write:

$$(dF_{O/Ba} dF_{O/Bb})=A*(dF_a dF_b)$$

Or $$DF_{O/B}=A*DF$$

Where $DF_{O/B}$ and DF are now the 2*2 matricies formed by joining two 2*1 column vectors side by side. Multiplying each side of the equation by the inverse of DF:

$$DF_{O/B}*\text{inv}(DF)=A*DF*\text{inv}(DF)$$

Yielding $$A=DF_{O/B}*\text{inv}(DF)$$

And thus the action matrix is now known, and may be used to calculate the correction required eliminating the measured F vectors. To illustrate all this here is a worked example. Suppose the machine in presently spinning at some constant speed, and the force vectors we measure at each end are:

$$F = \begin{bmatrix} 1\angle 0 \\ 2\angle 90 \end{bmatrix}$$

Now suppose we add one unit of water at 90° at end 1, and nothing at end 2, and the new force vectors become:

$$F_{new1} = \begin{bmatrix} 1.414\angle 45 \\ 2.236\angle 53.4 \end{bmatrix}$$

This gives:

$$dF_{O/Ba} = \begin{bmatrix} 1\angle 90 \\ 0\angle 0 \end{bmatrix} \text{ and } dF_a = \begin{bmatrix} 1\angle 90 \\ 1\angle 0 \end{bmatrix}$$

Now for the second run suppose we add 0.5 units of water at 0° at end 2, and nothing at end 1, and the new force vectors become:

$$F_{new2} = \begin{bmatrix} 2.414\angle 45 \\ 3.200\angle 57.7 \end{bmatrix}$$

This gives:

$$dF_{O/Ba} = \begin{bmatrix} 0\angle 0 \\ 0.5\angle 0 \end{bmatrix} \text{ and } dF_a = \begin{bmatrix} 1\angle 45 \\ 1\angle 45 \end{bmatrix}$$

$$\text{Thus } DF_{O/B} = \begin{bmatrix} 1\angle 90 & 0\angle 0 \\ 0\angle 0 & 0.5\angle 0 \end{bmatrix} \text{ And } DF = \begin{bmatrix} 1\angle 90 & 1\angle 45 \\ 1\angle 0 & 1\angle 45 \end{bmatrix}$$

$$\text{Thus } inv(DF) = \begin{bmatrix} 0.707\angle 225 & 0.707\angle 45 \\ 0.707\angle 0 & 0.707\angle 270 \end{bmatrix}$$

$$\text{And so } A = \begin{bmatrix} 0.707\angle 315 & 0.707\angle 135 \\ 0.354\angle 0 & 0.354\angle 270 \end{bmatrix}$$

With A now calculated and knowing F as measured by the load bridge, the required correction to counteract the imbalance can be calculated. Intially the action matrix is completely unknown thus we must make random guesses for the inital $F_{O/B}$ vectors. After we have some knowledge of the matrix we may make better guesses for the initial $F_{O/B}$ vectors.

Overall System Advantages

The advantages for the Washing Machine of employing and active balancing system are:

Forces due to imbalance are eliminated prior to bearing assemblies. Thus structural requirements are reduced, enabling less and/or cheaper material to be employed.

Suspension which wears out and deteriorates is eliminated.

Wash cylinder clearances reduced enabling ample load capacity in a machine of standard size.

Complexity of door opening mechanism also reduced because it no longer needs to cope with height changes on a suspension.

Quiet smooth spinning at all times.

Able to cope with variable external conditions.

What we claim is:

1. A laundry appliance having a perforated drum for dehydrating a clothes load, an electric motor adapted to rotate said drum at speed thereby dehydrating the load and a system for compensating for imbalances of said drum and any load carried therein during dehydration of the load, said system comprising:

at least one sensor located at more than one position on the drum spin axis for detecting rotational imbalance in the load, correction means for adding one or more masses to said drum, a digital processor which in use receives as inputs signals from said sensor, and programmed to calculate the value and position of one or more masses required to be added to the drum depending on at least said sensed imbalance and any past, current or future additions, said processor controlling such additions such that the resultant value and position is substantially similar to said modified value and position to correct the imbalance.

2. A laundry appliance having a perforated drum for dehydrating a clothes load, driving means adapted to rotate said drum at speed thereby dehydrating the load and a system for compensating for imbalances of said drum and any load carried therein during dehydration of the load, said system comprising:

at least one sensor located at more than one position on the spin axis of said drum for detecting rotational imbalance in the load, correction means for adding two or more masses to said drum to correct for any imbalance caused by the rotation thereof, and a digital processor which in use receives as inputs signals from said sensor and programmed with software causing said processor to carry out the following steps:

a) energising said electric motor to apply a first predetermined rate of rotation to said drum;

b) energising said correction means to add at least one small imbalance to at least one end of said drum and storing the detected rotational imbalances at each end of said drum;

c) determining the differential relationship between said at least one added imbalances' and said detected rotational imbalances' at each end of said drum, thereby estimating the value and position of one or more masses required to be added to the drum to correct the actual imbalance; and d) controlling additions of one or more masses to said drum by said correction means such that the resultant value and position of the added masses is substantially similar to the said estimated value and position to correct the imbalance.

3. A laundry appliance as claimed in claim 2 wherein said step (b) comprises the following steps:

b.1) energising said correction means to add a first small imbalance at one end of said drum;

b.2) storing the detected rotational imbalances at each end of said drum as a first measured imbalance and a second measured imbalance respectively;

b.3) energising said correction means to add a second small imbalance at the other end of said drum; and b.4) storing the subsequently detected rotational imbalances at each end of said drum as a third measured imbalance and a fourth measured imbalance respectively.

4. A laundry appliance having a perforated drum for dehydrating a clothes load, driving means adapted to rotate said drum at speed thereby dehydrating the load and at least two independent systems for compensating for imbalances of said drum and any load carried therein during dehydration of the load, each said system comprising:

at least one sensor located at one or more positions on the spin axis of said drum for detecting rotational imbalance in the load, a digital processor which in use receives as inputs signals from said sensor and programmed to estimate the value and position of one or more masses required to be added to the drum to correct the sensed imbalance, correction means for adding one or more masses to said drum, said processor in use controlling such additions such that the resultant value and position of the added masses is substantially similar as the said estimated value and position to correct the imbalance.

5. A laundry appliance according to claim 4, wherein said sensor and said correction means, for each respective system, are substantially proximate each other and/or there being a substantially rigid connection therebetween.

6. A laundry appliance having a perforated drum for dehydrating a clothes load, an electric motor adapted to rotate said drum at speed thereby dehydrating the load and a system for compensating for imbalances of said drum and any load carried therein during dehydration of the load, said system comprising:

at least one sensor located at more than one position on the drum spin axis for detecting rotational imbalance in the load, correction means for adding one or more masses to said drum, a digital processor which in use receives as inputs signals from said sensor and adapted to energise said electric motor and said correction means and programmed with software causing said processor to carry out the following steps:

1) monitor the rotational imbalance based on the output of said sensor;

2) energise said electric motor to redistribute the load within said drum if said estimated imbalance is above a first predetermined threshold;

3) if said estimated imbalance is below said first predetermined threshold determine the value and position of one or more masses required to be added to the drum to correct the sensed imbalance;

4) if said estimated imbalance is below said first predetermined threshold energise said correction means such that the resultant value and position of any additions is substantially similar to the calculated value and position to correct the imbalance; and 5) energise said electric motor to apply a further faster rate of rotation to said drum so as to effectively dehydrate said load.

7. A laundry appliance according to claim 6, wherein said step (5) further comprises the following steps:

5.a) estimating the rotational imbalance based on the output of said sensor;

5.b) if said estimated imbalance is below a second predetermined threshold, energising said electric motor to increase the rate of rotation of said drum by a predetermined increment;

5.c) if said estimated imbalance is above a second predetermined threshold, calculating a corresponding correction to counteract said imbalance;

5.d) if said estimated imbalance is above a second predetermined threshold, then adding one or more masses to said drum using said correction means, corresponding to said calculated correction; and 5.e) if the rate of rotation of said drum is below the level for effective dehydration of the load, then repeating steps (5.a) to (5.d).

8. A laundry appliance as claimed in claim 7 wherein said processor includes storage means adapted to store data including a predetermined number of said past corrections made by said correction means; and said step 5.c) comprises the following steps:

5.c.i) if said estimated imbalance is above a second predetermined threshold, estimating the steady state rotational imbalance based on the output of said sensor and said past corrections; and 5.c.ii) if said estimated imbalance is above a second predetermined threshold, calculating a corresponding correction based on said estimated steady state rotational imbalance.

9. A laundry appliance as claimed in claim 7 or 8 wherein said correction means has a fine mode of control and a coarse mode of control and said step (5.d) comprises the following steps:

5.d.i) if said estimated imbalance is above a second predetermined threshold but below a third predetermined threshold, then controlling said correction means under said fine mode of control to add one or more masses to said drum, corresponding to said calculated correction; and 5.d.ii) if said estimated imbalance is above a third predetermined threshold, then controlling said correction means under said coarse mode of control to add one or more masses to said drum, corresponding to said calculated correction.

10. A laundry appliance as claimed in any one of claims 1 to 6, wherein said sensor further comprises filtering means for conditioning the output of said sensor, said filtering means including:

a low pass filter for filtering the output of said sensor and providing as its output a low passed output signal;

position means for sensing the angle of said drum relative to a predetermined reference; and software programmed into said processor comprising the following steps:

I) multiplying said low passed output signal at predetermined angles, of rotation of said drum by a value according to the cosine of the angle of said drum resulting, in a first product;

ii) multiplying said low passed output signal at said predetermined angles of rotation of said drum by a value according to the sine of the angle of said drum, resulting in a second product;

iii) adding the values of said first product at each of a predetermined number of intervals over a full rotation of said drum and dividing the sum by the number of intervals thereof, to produce a first result;

iv) adding the values of said second product at each of said predetermined number of intervals over a full rotation of said drum and dividing the sum by said number of intervals, to produce a second result; and v) supplying, a complex number composed of said first result as the real component and said second result as the imaginary component, as the input to said processor in place of said output of said sensor.

11. A laundry appliance as claimed in any one of claims 1 to 6 wherein said sensor comprises at least one piezoelectric force transducer provided at each end of said drum adapted to detect the linear forces acting on said drum resulting from the rotation thereof.

12. A laundry appliance as claimed in claim 11 wherein said sensor further comprises at least one acceleration transducer provided at each end of said drum adapted to detect the linear accelerations acting on said drum resulting from the rotation thereof.

13. A laundry appliance as claimed in claim 12 wherein said correction means comprise two sets of angularly spaced chambers in an orthogonal plane to the spin axis provided at each end of said drum and means for injecting water into selected chambers in response to energisation by said processor.

* * * * *